US011040355B2

(12) United States Patent
Yoo et al.

(10) Patent No.: US 11,040,355 B2
(45) Date of Patent: Jun. 22, 2021

(54) ELECTRIC DUST COLLECTING FILTER AND ELECTRIC DUST COLLECTING DEVICE COMPRISING SAME

(71) Applicant: LG Electronics Inc., Seoul (KR)

(72) Inventors: Imsung Yoo, Seoul (KR); Joonho Pyo, Seoul (KR); Ayeong Lee, Seoul (KR); Taehee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/967,309

(22) PCT Filed: Jan. 31, 2019

(86) PCT No.: PCT/KR2019/001334
§ 371 (c)(1),
(2) Date: Aug. 4, 2020

(87) PCT Pub. No.: WO2019/151790
PCT Pub. Date: Aug. 8, 2019

(65) Prior Publication Data

US 2021/0001351 A1 Jan. 7, 2021

(30) Foreign Application Priority Data

Feb. 5, 2018 (KR) ..... 10-2018-0013930

(51) Int. Cl.
*B03C 3/47* (2006.01)
*B03C 3/70* (2006.01)
*B03C 3/45* (2006.01)

(52) U.S. Cl.
CPC ..... *B03C 3/47* (2013.01); *B03C 3/45* (2013.01); *B03C 3/70* (2013.01)

(58) Field of Classification Search
CPC combination set(s) only.
See application file for complete search history.

(56) References Cited

U.S. PATENT DOCUMENTS 2,868,319 A * 1/1959 Rivers ..... B03C 3/60 96/67
4,944,778 A * 7/1990 Yanagawa ..... B03C 3/155 96/66

(Continued)

FOREIGN PATENT DOCUMENTS

JP 08033856 A * 2/1996
JP H0833856 2/1996

(Continued)

*Primary Examiner* — Christopher P Jones
*Assistant Examiner* — Sonji Turner
(74) *Attorney, Agent, or Firm* — Fish & Richardson P.C.

(57) ABSTRACT

An electric dust collecting filter includes a plurality of film electrodes that are arranged apart from each other at regular intervals and form an electric field to collect foreign matter in the air. The film electrode includes an insulating part that defines one surface and the other surface of the film electrode, a first electrode part disposed on one side inside the insulating part and having a plurality of first wire electrodes spaced apart from each other, and a second electrode part disposed on the other side inside the insulating part and having a plurality of second wire electrodes that are disposed between the plurality of first wire electrodes spaced apart from each other and provided alternately with the plurality of first wire electrodes.

13 Claims, 9 Drawing Sheets

(56) References Cited

U.S. PATENT DOCUMENTS

| | | | | |
|---|---|---|---|---|
| 10,168,059 | B2 * | 1/2019 | Yamaguchi | B03C 3/155 |
| 2017/0120256 | A1 * | 5/2017 | Jeon | B03C 3/45 |
| 2017/0120257 | A1 * | 5/2017 | Lee | B03C 3/86 |

FOREIGN PATENT DOCUMENTS

| | | | | |
|---|---|---|---|---|
| JP | 10237197 | A | * | 9/1998 |
| JP | 10241828 | A | * | 9/1998 |
| KR | 20110045851 | | | 5/2011 |
| KR | 20170051208 | | | 5/2017 |
| KR | 20170053865 | | | 5/2017 |
| KR | 20170097363 | | | 8/2017 |
| KR | 20170103111 | | | 9/2017 |

* cited by examiner (a)

(b)

(a)

(b)

ELECTRIC DUST COLLECTING FILTER AND ELECTRIC DUST COLLECTING DEVICE COMPRISING SAME

CROSS-REFERENCE TO RELATED APPLICATIONS

This application is a National Stage application under 35 U.S.C. § 371 of International Application No. PCT/KR2019/001334, filed on Jan. 31, 2019, which claims the benefit of Korean Patent Application No. 10-2018-0013930, filed on Feb. 5, 2018. The disclosures of the prior applications are incorporated by reference in their entirety.

TECHNICAL FIELD

The present invention relates to an electric dust collecting filter and an electric dust collecting device including the same.

BACKGROUND ART

A general electric dust collecting filter is a device that is mounted on an air conditioner or an air purifier to charge and collect foreign matters contained in air. The electric dust collecting filter includes a charging part that discharges the foreign matters in the air and charges the foreign matters and a dust collecting part that generates electric fields to collect the foreign matters charged by the charging part by using electrostatic force. When the air passes through the charging part and the dust collecting part, the foreign matters in the air are charged in the charging part, and then the charged foreign matters are collected in the dust collecting part.

For example, referring to Korea Patent Publication No. 10-2017-0103111, titled "electric dust collecting device", a dust collecting part of the electric dust collecting device includes a plurality of electrodes, and the plurality of electrodes are spaced apart from each other to generate electric fields. The dust collecting part of the electric dust collecting device uses an electrode in the form of a film, which is lightweight and has good moldability, as the electrodes for generating the electric fields.

However, in the case of the related art, in the process of removing the foreign matters collected on the electrode having the film shape, frictional force between the foreign matters charged by the electric fields and the surface of the electrode increases, and thus, the foreign matters are not separated from the surface of the electrode to deteriorate dust collecting efficiency of an electric dust collecting filter.

DISCLOSURE OF THE INVENTION

Technical Problem

An object of the present invention is to provide an electric dust collecting filter that collects foreign matters in air to generate electric fields for removing the collected foreign matters and an electric dust collecting device including the same.

Technical Solution

An electric dust collecting filter according to the present invention includes a plurality of film electrodes disposed to be spaced a predetermined distance from each other, wherein DC power different from each other are respectively applied to the film electrodes adjacent to each other of the plurality of film electrodes to generate electric fields between the film electrode adjacent to each other and collect foreign matters, which are contained in air flowing between the plurality of film electrodes, onto the plurality of film electrodes, thereby providing clean air.

Also, each of the film electrodes of the electric dust collecting filter according to the present invention may include a first electrode part provided with a plurality of first wire electrodes spaced apart from each other and a second electrode part provided with second wire electrodes that are respectively provided between the plurality of first wire electrodes and are alternately disposed with the plurality of first wires, wherein AC power different from each other may be applied to the first electrode part and the second electrode part to generate electric fields between the plurality of first wire electrodes and the plurality of second wire electrodes, thereby separating the foreign matters, which are previously collected on the electric dust collecting filter, from the electric dust collecting filter.

Also, each of the film electrodes of the electric dust collecting filter according to the present invention may include a plurality of first wire electrodes spaced apart from each other, a plurality of second wire electrode that are alternately disposed with the plurality of first wire electrodes, and a third wire electrode disposed between the first wire electrode and the second wire electrode, which are adjacent to each other, wherein AC power different from each other may be applied to the first wire electrode, the second wire electrode, and the third wire electrode to generate electric fields between the first wire electrode, the second wire electrode, and the third wire electrodes, separate foreign matters, which are previously collected on the plurality of dust collecting filters, from the electric dust collecting filter, and adjust a moving direction of the separated foreign matters.

Advantageous Effects

According to the present invention, the power applied to the plurality of electrode parts provided in each of the electric dust collecting filters may be adjusted to collect the foreign matters in the air or separate the previously collected foreign matters from the electric dust collecting filters, thereby efficiently removing the foreign matters.

In addition, according to the present invention, each of the electric dust collecting filters may include the plurality of wire electrodes to smoothly generate the electric fields between the plurality of film electrode disposed to be spaced the predetermined distance from each other.

In addition, according to the present invention, the plurality of wire electrodes may be alternately disposed with respect to each other to generate smoothly the electric fields between the wire electrodes that are adjacent to each other and minimize the areas of the electric dust collecting filters, on which the foreign matters previously collected by the electric fields are not separated.

MODE FOR CARRYING OUT THE INVENTION

Hereinafter, an electric dust collecting filter according to a first embodiment of the present invention will be described based on the drawings.

Figure 1:
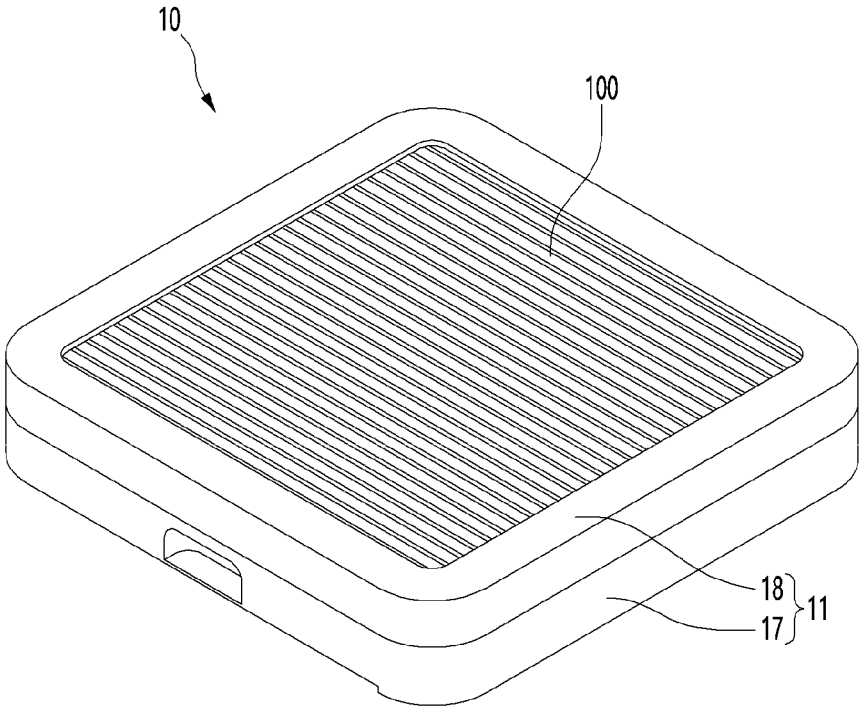
FIG. 1 is a perspective view of an electric dust collecting device according to a first embodiment of the present invention.

FIG. 1 is a perspective view of an electric dust collecting device according to a first embodiment of the present invention, and FIG. 1 is an exploded perspective view of the electric dust collecting device according to the first embodiment of the present invention.

Figure 2:
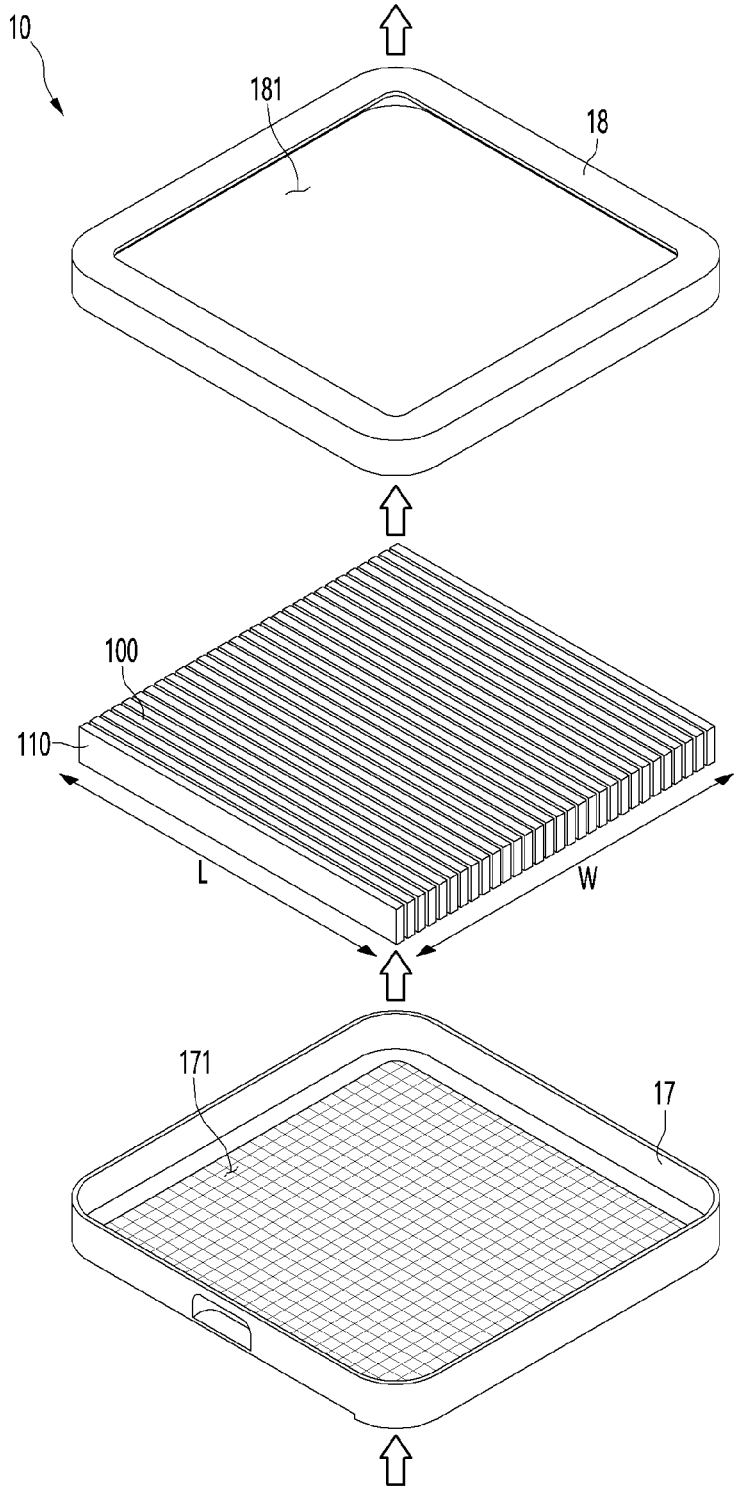
FIG. 2 is an exploded perspective view of the electric dust collecting device according to the first embodiment of the present invention.

Referring to FIGS. 1 and 2, an electric dust collecting filter 10 according to a first embodiment of the present invention includes a case 11 defining a main body and a dust collecting part 100 that charges foreign matters in air to collect the charged foreign matters. Here, the dust collecting part 100 may be referred to as an "electric dust collecting filter".

A space may be defined in the case 11. The dust collecting part 100 may be disposed inside the case 11.

The case 11 may include a first case 17 accommodating a portion of the dust collecting part 100 therein and a second case 18 accommodating the remaining portion of the dust collecting part 100 therein. The dust collecting part 100 may be coupled to the inside of the first case 17 and the second case 18. The first case 17 and the second case 18 may be coupled to each other. In this embodiment, the first case 17 may be disposed below the dust collecting part 100, and the second case 18 may be disposed above the dust collecting part 100.

An inflow part 171 into which external air is introduced may be provided in the first case 17. A discharge part 181 from which the air introduced into the inflow part 171 is discharged may be provided in the second case 18. That is, the air introduced into the inflow part 171 may be discharged to the discharge part 181 after passing through the dust collecting part 100. Also, a prefilter, a mesh filter, and the like for filtering foreign matters having relatively large particles from the flowing air may be further provided in the inflow part 171 and the discharge part 181.

The dust collecting part 100 may be constituted by a plurality of dust collecting plates 110. The plurality of dust collecting plates 110 may be disposed to be spaced a predetermined distance from each other. In detail, each of the plurality of dust collecting plates 110 may be provided in a band shape having a length direction L longer than a width direction W thereof. Each of the plurality of dust collecting plates 110 may be arranged to be spaced apart from each other in the width direction W. The dust collecting plates 110 adjacent to each other may have one surfaces facing each other.

The dust collecting part 100 may be provided to correspond to the inflow part 171 and the discharge part 181 and may be disposed inside the case 11. The air introduced into the inflow part 171 may flow to the discharge part 181 after passing through the dust collecting part 100, and the foreign matters may be separated from the air in the process of passing through the dust collecting part 100.

The dust collecting part 100 may charge the foreign matters in the air by applying a high voltage to collect the charged foreign matters. For this, each of the plurality of dust collecting plates 110 constituting the dust collecting part 100 may be provided with electrode parts 130 and 140 (see FIG. 3). The dust collecting part 100 may charge the foreign matters in the air or collect the charged foreign matters according to a change in high voltage applied to each of the plurality of dust collecting plates 110. A power source 19 (see FIG. 5) that applies a high voltage may be connected to the dust collecting part 100. A controller (not shown) may be further provided in the power source 19 to control the high voltage applied to the dust collecting part 100. Also, a grounding part (not shown) for grounding may be further connected to the dust collecting part 100.

The dust collecting part 100 according to the first embodiment of the present invention may be applied to high-voltage DC power or AC power. When the high-voltage DC power is applied to the dust collecting part 100, the dust collecting part 100 may charge the foreign matters in the air and collect the charged foreign matters. On the other hand, when the high-voltage AC power is applied to the dust collecting part 100, the dust collecting part 100 may separate the foreign matters, which are collected on a surface of the dust collecting part 100, from the surface of the dust collecting part 100.

Hereinafter, the dust collecting plate 110 constituting the dust collecting part 100 will be described in detail.

Figure 3:
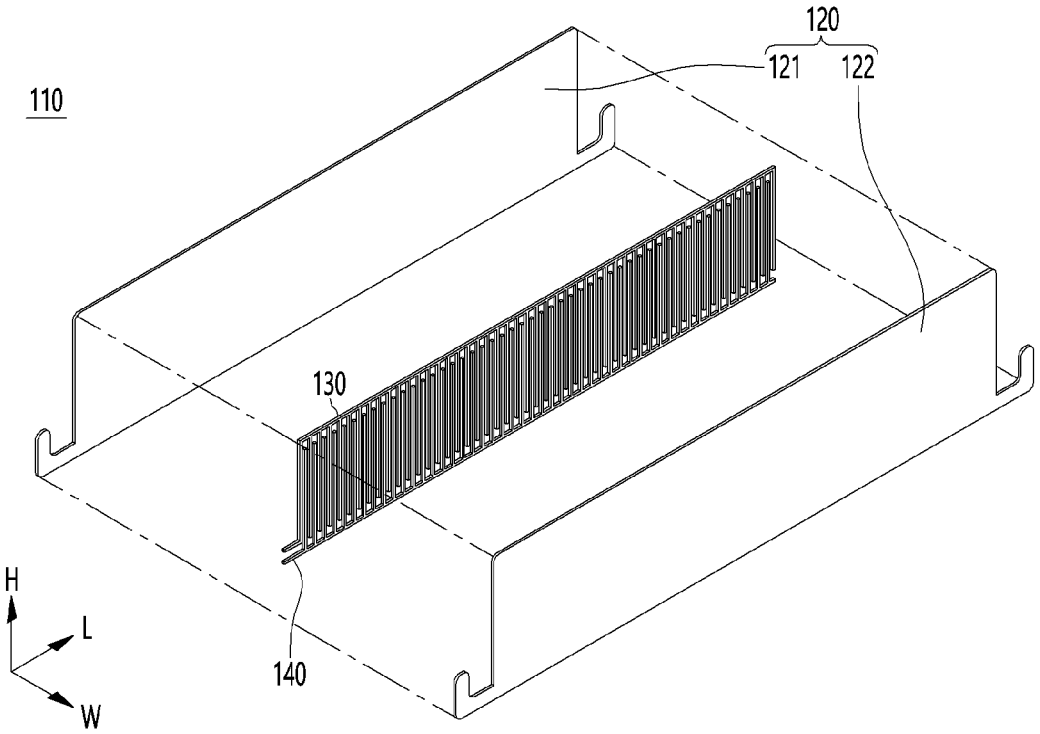
FIG. 3 is an exploded perspective view of a dust collecting plate according to the first embodiment of the present invention.
Figure 4:
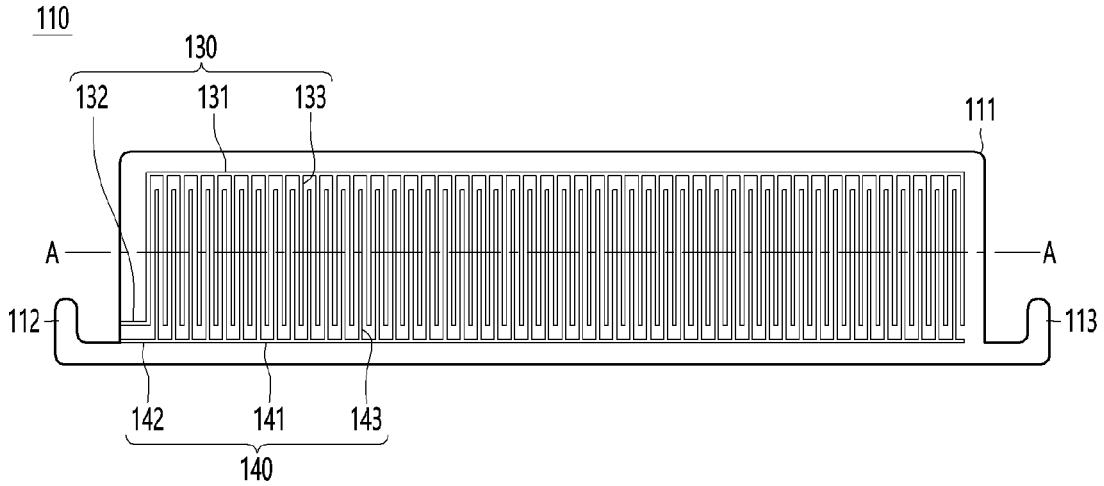
FIG. 4 is a front view of the dust collecting plate according to the first embodiment of the present invention.
Figure 5:
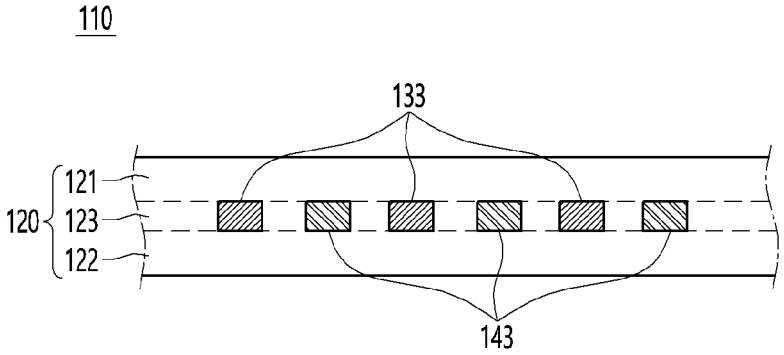
FIG. 5 is a cross-sectional view taken along line A-A of FIG. 4.
Figure 6:
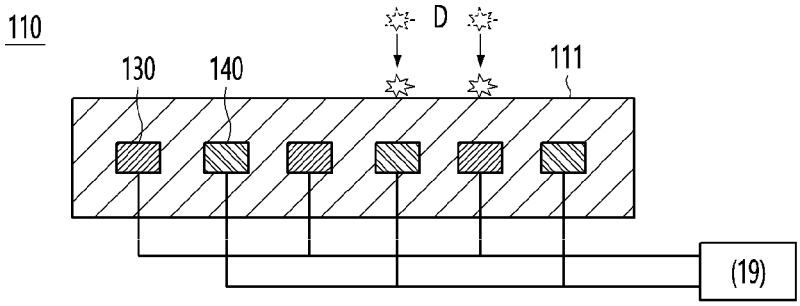
FIG. 6 is a view illustrating a state in which power is applied to the dust collecting plate according to the first embodiment of the present invention.
Figure 6:
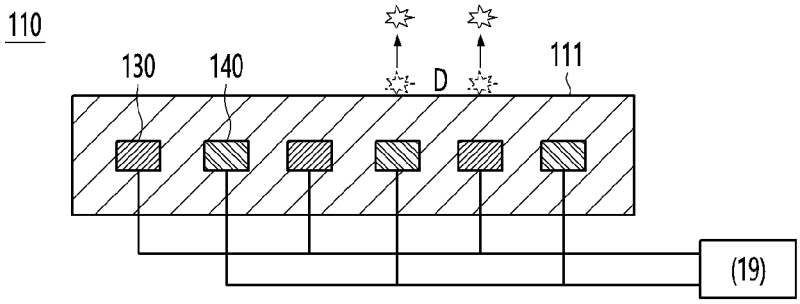

FIG. 3 is an exploded perspective view of the dust collecting plate according to the first embodiment of the present invention, FIG. 4 is a front view of the dust collecting plate according to the first embodiment of the present invention, FIG. 5 is a cross-sectional view taken along line A-A of FIG. 4, and FIG. 6 is a view illustrating a state in which power is applied to the dust collecting plate according to the first embodiment of the present invention.

Referring to FIGS. 3 to 6, the dust collecting plate 110 according to the first embodiment of the present invention may include a dust collecting plate body 111 defining a main body.

The dust collecting plate body 111 may be provided in a band shape having a length direction L and a height direction H, which are longer than a width direction W thereof. In this embodiment, air may flow in the height direction H of the dust collecting plate body 111, and the foreign matters contained in the air may be attached to both side surfaces of the dust collecting plate body 111. Here, the both side surfaces may be understood as both side surfaces defined in the height direction H and the length direction L of the dust collecting plate body 111. Also, the dust collecting plate body 111 may extend by a predetermined length or more in the height direction H, which is a direction parallel to the flow direction of the air. The predetermined length is to increase in time and area, in which the air is capable of contacting both side surfaces of the dust collecting plate body 111 while the air flows.

The dust collecting plate body 111 may include a first fixing part 112 and a second fixing part 113. The first fixing part 112 and the second fixing part 113 may be understood as units for fixing the dust collecting plate body 111 to the case 11. The first fixing part 112 may be disposed on one side of the dust collecting plate body 111, and the second fixing part 113 may be disposed on the other side of the collecting plate body 111. In this embodiment, the first fixing part 112 may be disposed at a left side of the dust collecting plate body 111, and the second fixing part 113 may be disposed at a right side of the collecting plate body 111. Each of the first fixing part 112 and the second fixing part 113 may protrude from the dust collecting plate body 111. A portion of each of the protruding first fixing part 112 and the protruding second fixing part 113 may be bent. In this embodiment, each of the protruding first fixing part 112 and the protruding second fixing part 113 may be bent upward.

The dust collecting plate 110 may include an insulating part 120 and electrode parts 130 and 140.

The dust collecting plate body 111 may define a main body by the insulating part 120 and the electrode parts 130 and 140. The electrode parts 130 and 140 may be provided in plurality. In this embodiment, the electrode parts 130 and 140 may include a first electrode part 130 and a second electrode part 140. The plurality of electrode parts 130 and 140 may be disposed to be spaced a predetermined distance from each other. Different electrodes or the same electrode may be applied to each of the plurality of electrode parts 130 and 140 according to the situation. In addition, each of the electrode parts 130 and 140 may be made of a conductive material. For example, the conductive material may be provided with copper, indium, carbon paste, or the like.

The insulating part 120 may be disposed to surround the electrode parts 130 and 140. The insulating part 120 may prevent different electrode parts from contacting each other. Also, when power is applied to the electrode parts 130 and 140, the insulating part 120 may provide an attachment surface to which the foreign matters in the air are attached. The insulating part 120 may include a first insulating film 121 and a second insulating film 122. The insulating part 120 may be made of an insulating material. For example, the insulating material may be provided with glass, PCB, plastic, or the like.

In this embodiment, the dust collecting plate 110 may be referred to as a "film electrode". This is because the dust collecting plate 110 has a long band shape, the electrode parts 130 and 140 are disposed inside the dust collecting plate 110, and the insulating part 120 surrounds the outside of each of the electrode parts 130 and 140. When the dust collecting plate 110 is referred to as the "film electrode", the dust collecting plate body 111 may be referred to as a "film electrode body".

Hereinafter, the electrode parts 130 and 140 and the insulating part 120 will be described in detail.

The first electrode part 130 of the electrode parts 130 and 140 may include a first electrode part body 131, a first power apply part 132, and a first wire 133. The first electrode body 131 may be disposed in an upper portion of the dust collecting plate body 111. The first power apply part 132 and the first wire 133 may extend from the first electrode part body 131. The first power apply part 132 may be connected to the power source 19. The first electrode part 130 may receive power from the power source 19 through the first power apply part 132. The first wire 133 may be provided in plurality. The plurality of first wires 133 may be disposed to be spaced apart from each other. The plurality of first wires 133 according to this embodiment may extend downward from the first electrode part body 131. Also, a second wire 143, which will be described later, may be disposed between the first wires 133 adjacent to each other. For example, the first electrode part 130 may be provided in the form of a hair comb in which a combs are disposed downward from an upper side. Also, the first wire 133 may be referred to as a "first wire electrode".

The second electrode part 140 of the electrode parts 130 and 140 may include a second electrode part body 141, a second power apply part 142, and a second wire 143. The second electrode part body 141 may be disposed in a lower portion of the dust collecting plate body 111. The second power apply part 142 and the second wire 143 may extend from the second electrode part body 141. The second power apply part 142 may be connected to the power source 19. The second electrode part 140 may receive power from the power source 19 through the second power apply part 142. The second wire 143 may be provided in plurality. The plurality of second wires 143 may be disposed to be spaced apart from each other. The plurality of second wires 143 according to this embodiment may extend upward from the second electrode part body 141. Also, the first wire 133 may be disposed between the second wires 143 adjacent to each other. For example, the second electrode part 140 may be provided in the form of a hair comb in which combs are disposed downward from the upper side. Also, the second wire 143 may be referred to as a "second wire electrode".

That is, the first wire 133 and the second wire 143 may be alternately disposed while being spaced apart from each other. Alternatively, the first wire 133 and the second wire 143 may be repeatedly disposed in a state of being spaced apart from each other. Also, the first wire 133 and the second wire 143 may extend in a direction parallel to the flow direction. As a distance between the first wire 133 and the second wire 143 decreases, the foreign matters collected on the surface of the dust collecting plate 110 may be effectively separated from the surface of the dust collecting plate 110.

The first insulating film 121 of the insulating part 120 may be disposed at one side of each of the electrode parts 130 and 140. The second insulating film 122 of the insulating part 120 may be disposed at the other side of each of the electrode parts 130 and 140. The first insulating film 121 and the second insulating film 122 may be coupled to each other to surround the electrode parts 130 and 140. That is, the electrode parts 130 and 140 may be disposed inside the first insulating film 121 and the second insulating film 122.

The insulating part 120 may further include a connection film 123. The connection film 123 may be disposed in a space defined between the first wire 133 of the first electrode part 130 and the second wire 143 of the second electrode part 140 to connect the first insulating film 121 to the second insulating film 122. Also, the connection film 123 may be understood as a portion at which the first insulating film 121 and the second insulating film 122 protrude to be coupled to each other.

The dust collecting part 100 may receive power from the power source 19. Each of the plurality of dust collecting plates 110 may be connected to the power source 19. In detail, the first power apply part 132 of the first electrode part 130 and the second power apply part 142 of the second electrode part 140 may be connected to the power source 19. The power source 19 may supply DC power, which are different from each other, to the plurality of dust collecting plates 110, respectively. In addition, the power source 19 may supply AC power, which are different from each other, to the first electrode part 130 and the second electrode part 140 provided in the plurality of dust collecting plates 110, respectively.

That is, the dust collecting part 100 may operate in a "dust collecting mode" and a "dust separating mode" according to whether AC power or DC power is supplied to the dust collecting part 100, and whether a positive (+) or negative (−) pole is applied to the first electrode part 130 and the second electrode part 140, which are respectively provided in the plurality of dust collecting plates 110.

(a) of FIG. 6 is a view illustrating a state in which charged foreign matters D are collected on one dust collecting plate 110 in the "dust collecting mode".

(b) of FIG. 6 is a view illustrating a state in which the foreign matters D, which are previously collected on the one dust collecting plate 110, are separated from the one dust collecting plate 110 in the "dust separating mode".

Figure 7:
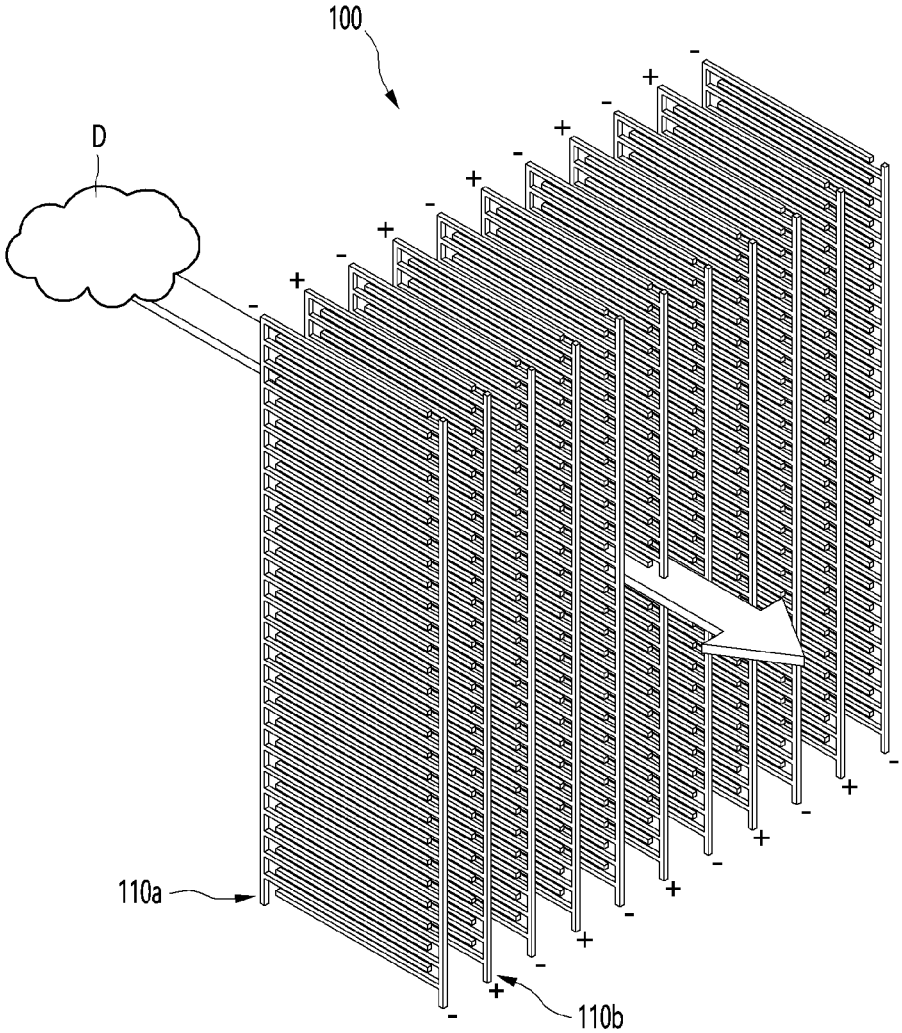
FIG. 7 is a view illustrating a state in which foreign matters are collected on the dust collecting part according to the first embodiment of the present invention.
Figure 8:
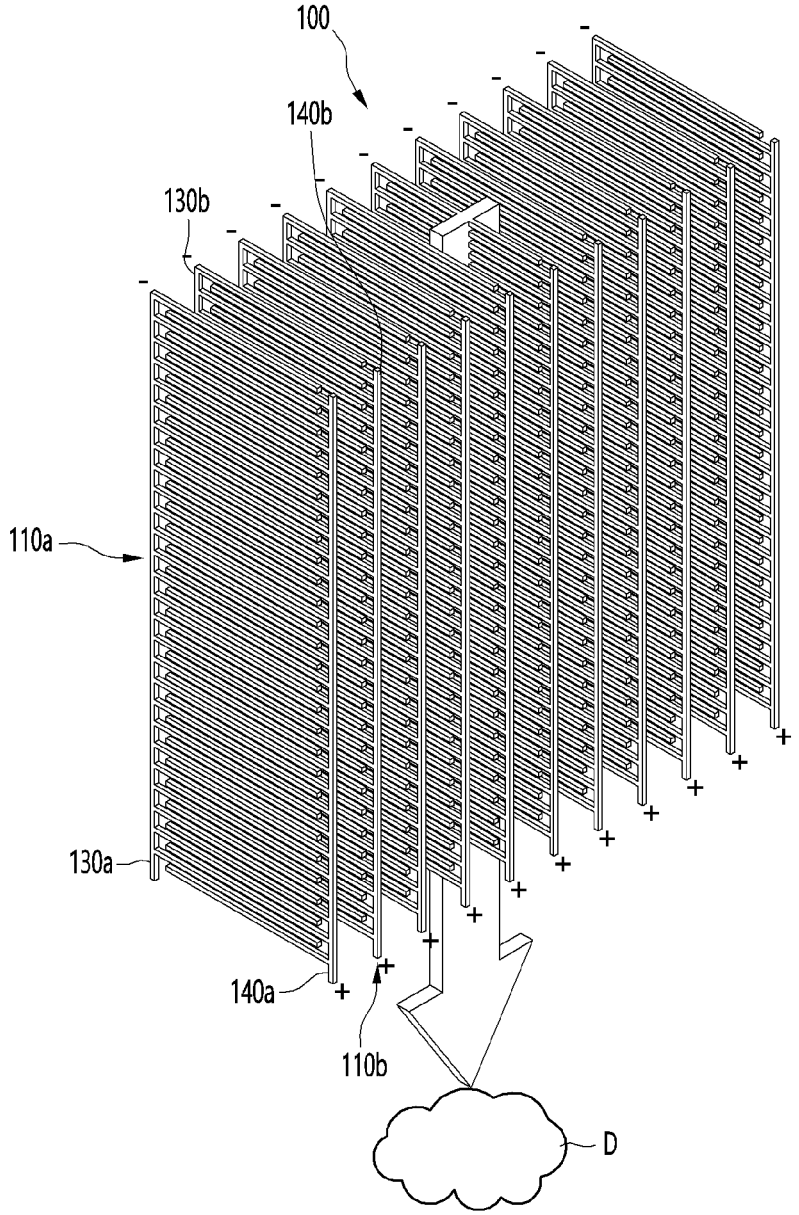
FIG. 8 is a view illustrating a state in which the foreign matters collected on the dust collecting part are separated according to the first embodiment of the present invention.

FIG. 7 is a view illustrating a state in which the foreign matters are collected on the dust collecting part according to the first embodiment of the present invention, and FIG. 8 is a view illustrating a state in which the foreign matters collected on the dust collecting part are separated according to the first embodiment of the present invention.

Referring to FIGS. 7 and 8, when the collecting foreign matters in the air are collected through the dust collecting part 100, the power source 19 may supply different DC power to the plurality of dust collecting plates 110, respectively. Here, the collection of the foreign matters in the air through the dust collecting part 100 may be referred to as a "dust collecting mode".

In detail, power having a negative (−) pole may be applied to one dust collecting plate 110*a* of the plurality of dust collecting plates 110, and power having a positive (+) pole may be applied to the other dust collecting plate 110*b*. The one dust collecting plate 110*a* to which the power having the negative (−) pole is applied and the other dust collecting plate 110*b* to which the power having the positive (+) pole is applied may be disposed adjacent to each other. That is, the power source 19 may alternately supply the negative (−) and positive (+) poles to the plurality of dust collecting plates 110. Alternatively, the power source 19 may sequentially supply the negative (−) and positive (+) poles to the plurality of dust collecting plates 110. Here, the same negative (−) power is applied to the first electrode part 130 and the second electrode part 140 of the one dust collecting plate 110*a*, and the same positive (+) power may be applied to the first electrode part 130 and the first electrode part 130 of the other dust collecting plate 110*b*.

Thus, when different DC power are applied to the one dust collecting plate 110*a* and the other dust collecting plate 110*b*, which are adjacent to each other, the foreign matters contained in the air passing between the one dust collecting plate 110*a* and the other dust collecting plate 110*b* may be charged in the dust collecting plate and thus be collected on the other dust collecting plate 110*b*.

When the foreign matters collected on the surface of the dust collecting part 100 are separated from the dust collecting part 100, the power source 19 may supply AC power, which are different from each other, to the first electrode part 130 and the second electrode part 140 provided in the plurality of dust collecting plates 110, respectively. Here, the separation of the foreign matters collected in the dust collecting part 100 from the dust collecting plate 110 may be referred to as a "dust separating mode". Also, the AC power applied to the first electrode part 130 and the second electrode part 140 provided in each of the dust collecting plates 110 may be controlled in waveform, frequency, voltage to adjust a degree of separation of the foreign matters from the dust collecting plate 110. For example, the waveform of the AC power may be provided as a sine waveform or a square waveform.

In detail, the negative (−) power may be applied to the first electrode part 130*a* provided in one dust collecting plate 110*a* of the plurality of dust collecting plates 110, and the positive (+) power may be applied to the second electrode part 140*a*. The negative (−) power, which is applied to the first electrode part 130*a*, may be transmitted to the plurality of first wires 133, and the positive (+) power, which is applied to the second electrode part 140*a*, may be transmitted to the plurality of second wires 143. The negative (−) power may be applied to the first electrode part 130*b* provided in the other dust collecting plate 110*b* of the plurality of dust collecting plates 110, and the positive (+) power may be applied to the second electrode part 140*b*. The negative (−) power, which is applied to the first electrode part 130*b*, may be transmitted to the plurality of first wires 133, and the positive (+) power, which is applied to the second electrode part 140*b*, may be transmitted to the plurality of second wires 143. Also, the one dust collecting plate 110*a* and the other dust collecting plate 110*b* may be disposed adjacent to each other.

Thus, when the different AC power are applied to the first electrode parts 130*a* and 140*a* and the second electrode parts 130*b* and 140*b*, which are provided in the one dust collecting plate 110*a* and the other dust collecting plate 110*b*, the foreign matters collected on the surface of the dust collecting plate 110 may be separated from the surface of the dust collecting plate 110 by electric force generated between the first electrode parts 130*a* and 140*a* and the second electrode parts 130*b* and 140*b*. The foreign matters separated from the dust collecting part 100 may fall in the direction of gravity by its own weight.

According to the configuration of the present invention, the foreign matters contained in the air may be removed through the dust collecting mode of the dust collecting part 100. The high-voltage DC power may be applied to the different dust collecting plates 110 to collect the foreign matters, thereby improving collecting efficiency of the foreign matters contained in the air.

Also, the foreign matters collected in the dust collecting part 100 may be easily removed through the dust separating mode of the dust collecting part 100. The foreign matters attached to the surface of the dust collecting part 100 may be pushed out by the electric force generated by applying the high voltage AC power between the first electrode part 130 and the second electrode part 140 of the dust collecting part 100 to cleanly remove the foreign matters attached to the dust collecting part 100.

Figure 9:
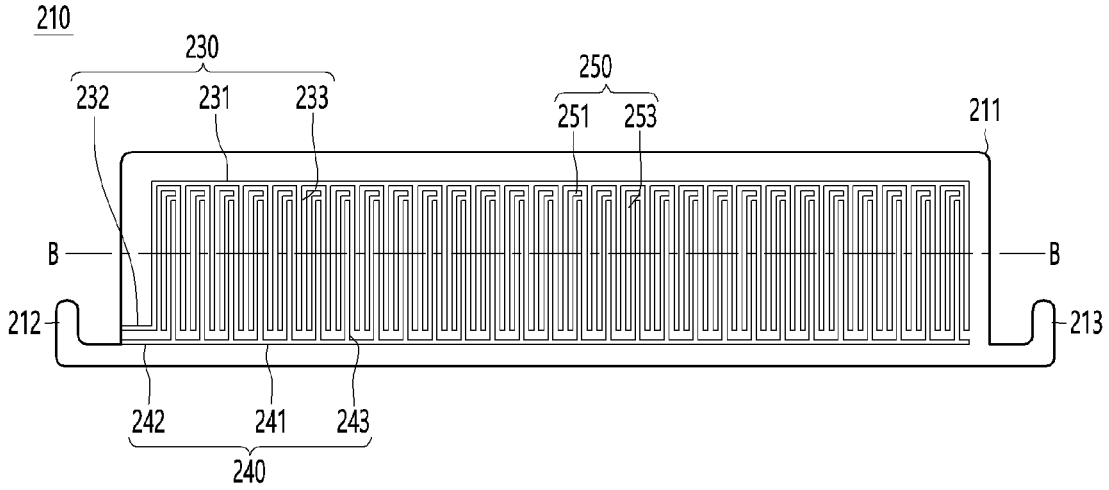
FIG. 9 is a front view of a dust collecting plate according to a second embodiment of the present invention.
Figure 10:
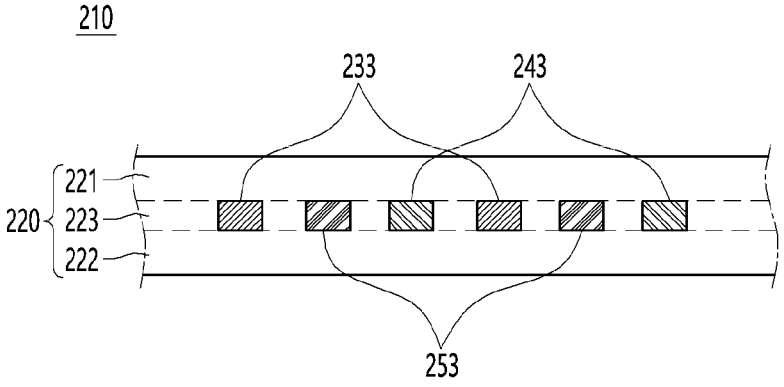
FIG. 10 is a cross-sectional view taken along line B-B of FIG. 9.
Figure 11:
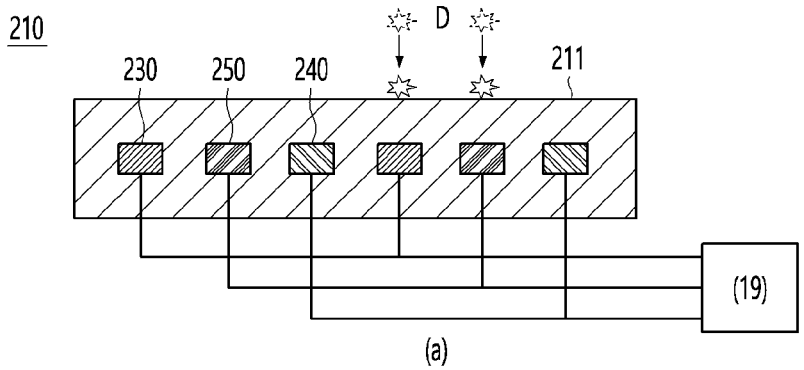
FIG. 11 is a view illustrating a state in which power is applied to the dust collecting plate according to the second embodiment of the present invention.
Figure 11:
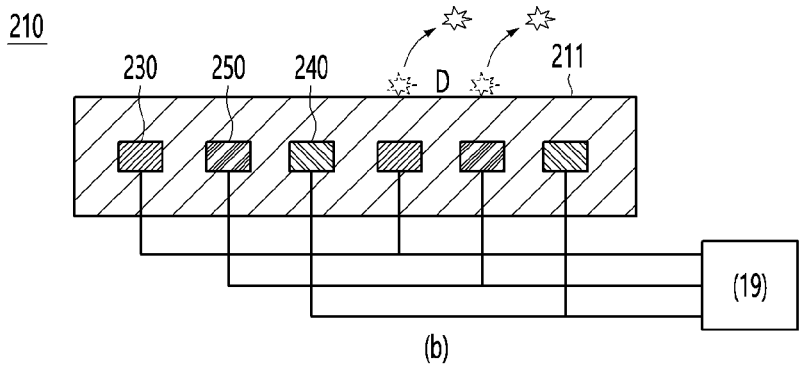

FIG. 9 is a front view of a dust collecting plate according to a second embodiment of the present invention, FIG. 10 is a cross-sectional view taken along line B-B of FIG. 9, and FIG. 11 is a view illustrating a state in which power is applied to the dust collecting plate according to the second embodiment of the present invention.

Referring to FIGS. 9 to 11, a dust collecting plate 210 according to a second embodiment of the present invention is characterized in that the number of electrode parts is changed in the description of the dust collecting plate according to the first embodiment. Thus, in the second embodiment, the description of the same configuration as the first embodiment may be cited from the description of the first embodiment.

A dust collecting part according to the second embodiment of the present invention may include a plurality of dust collecting plates 210. Also, each of the plurality of dust collecting plates 210 may include a dust collecting plate body 211. The dust collecting plate body 211 may include an insulating part 220 and a plurality of electrode parts 230, 240, and 250. The dust collecting plate body 211 may define a main body of the dust collecting plate 210 and may further include a first fixing part 212 and a second fixing part 213.

The insulating part 220 may be provided to surround the plurality of electrode parts 230, 240, and 250 and may include a first insulating film 221 and a second insulating film 222. Also, the insulating part 120 may further include a connection film 223 for connecting the first insulating film 221 to the second insulating film 222.

The plurality of electrode parts 230, 240, and 250 may be disposed inside the insulating part 220. In detail, the plurality of electrode parts 230, 240, and 250 may be disposed between the first insulating film 221 and the second insulating film 222. Also, the plurality of electrode parts 230, 240, and 250 may be disposed to be spaced apart from each other inside the insulating part 220.

The plurality of electrode parts 230, 240, and 250 may include a first electrode part 230, a second electrode part 240, and a third electrode part 250. The first electrode part 230, the second electrode part 240, and the third electrode part 250 may be sequentially disposed in a state of being spaced apart from each other. In this embodiment, the plurality of electrode parts 230, 240, and 250 may be provided in at least three or more. The plurality of electrode parts 230, 240, and 250 may be connected to a power source 19 to receive power. In this embodiment, the third electrode part 250 will be described as being disposed between the first electrode part 230 and the second electrode part 240. Also, the first electrode part 230, the second electrode part 240, and the third electrode part 250 may be disposed to be spaced a uniform interval from each other.

The first electrode part 230 may include a first electrode part body 231, a first power apply part 232, and a plurality of first wires 233. The second electrode part 240 may include a second electrode part body 241, a second power apply part 242, and a plurality of second wires 243. The plurality of first wires 233 may extend from the first electrode part body 231, and the plurality of second wires 243 may extend from the second electrode part body 241. Each of the second wires 243 may be disposed between the plurality of first wires 233 adjacent to each other. Also, each of the first wires 233 may be disposed between the plurality of second wires 243 adjacent to each other. In this embodiment, the third electrode part 250 may be disposed between the first wire 233 and the second wire 243 that are adjacent to each other.

The third electrode part 250 may include a third electrode part body 251 and a third wire 253.

The third electrode part body 251 may be disposed between the first electrode part 230 and the second electrode part 240, which are spaced apart from each other. The third electrode part body 25 may be provided in plurality, and each of the plurality of third electrode part bodies 25 may be provided between first and second wires 233 and 243 that are adjacent to each other. The third electrode part body 251 may function as a third apply part. The third electrode part bodies 251 spaced apart from each other may be connected to each other. That is, the plurality of third electrode part bodies 251 may be connected to the power source 19 to receive the same power. In this embodiment, the third electrode part body 251 may be disposed between one first wire 233 of the plurality of first wires 233 adjacent to each other and the second wire 243 disposed between the plurality of first wires 233. Also, the third electrode part body 251 may be disposed in an upper portion of the dust collecting plate body 211.

The third wire 253 may extend from the third electrode body 251. The third wire 253 may be disposed between the first wire 233 and the second wire 243. The third wire 253 may extend in a direction parallel to the first wire 233 and the second wire 243. In this embodiment, the third wire 253 may extend in a direction that is directed downward from the upper side of the dust collecting plate body 211. Also, the third wire 253 may be disposed to be spaced apart from the first electrode part 230 and the second electrode part 240.

That is, the first wire 233, the second wire 243, and the third wire 253 may be disposed parallel to each other in the dust collecting plate 210 according to this embodiment. In addition, the first wire 233, the second wire 243, and the third wire 253 may extend in a direction parallel to a flow direction of air.

The dust collecting part may perform a "dust collecting mode" or "a dust separating mode" according to a change in power applied to the first electrode part 230, the second electrode part 240, and the third electrode part 250, which are respectively provided in the dust collecting plates 210.

According to the configuration according to the second embodiment of the present invention, when the separation of the foreign matters collected on a surface of the dust collecting plate 210 are separated from the surface of the dust collecting plate 210 in the dust separating mode, a moving direction of the foreign matters may be adjusted.

In detail, the third wire 253 may be disposed between the first wire 233 and the second wire 243, and AC power may be respectively applied to the first wire 233, the second wire 243, and the third wire 253. Here, the AC power respectively applied to the first wire 233, the second wire 243, and the third wire 253 may be controlled in waveform, frequency, voltage to adjust a degree of separation of the foreign matters from the dust collecting plate 110 and the moving direction of the separated foreign matters. For example, the waveform of the AC power may be provided as a square waveform. Also, a phase difference of the AC power may be provided at an interval of 120 degree.

When the moving direction in which the foreign matters separated from the dust collecting plate 210 move is adjusted, the diversity of positions at which the dust collecting plate 210 is installed may increase. That is, in a state in which the dust collecting plate 210 is disposed in a horizontal direction, when the foreign matters collected on a top surface of the dust collecting plate 210 are removed, the moving direction of the separated foreign matters may be adjusted to easily remove the foreign matters existing on the top surface of the dust collecting plate 210. Also, since the moving direction of the separated foreign matters is adjusted to allow the foreign matters to move to a desired position, a maintenance and repair operation may be easy.

(a) of FIG. 11 is a view illustrating a state in which charged foreign matters D are collected on one dust collecting plate 210 in the "dust collecting mode".

(b) of FIG. 11 is a view illustrating a state in which the foreign matters D, which are previously collected on the one dust collecting plate 210, are separated from the one dust collecting plate 210 in the "dust separating mode". Here, the foreign matters D separated from the dust collecting plate 210 may move in a state of having directionality by electric fields generated in the dust collecting plate 210.

Figure 12:
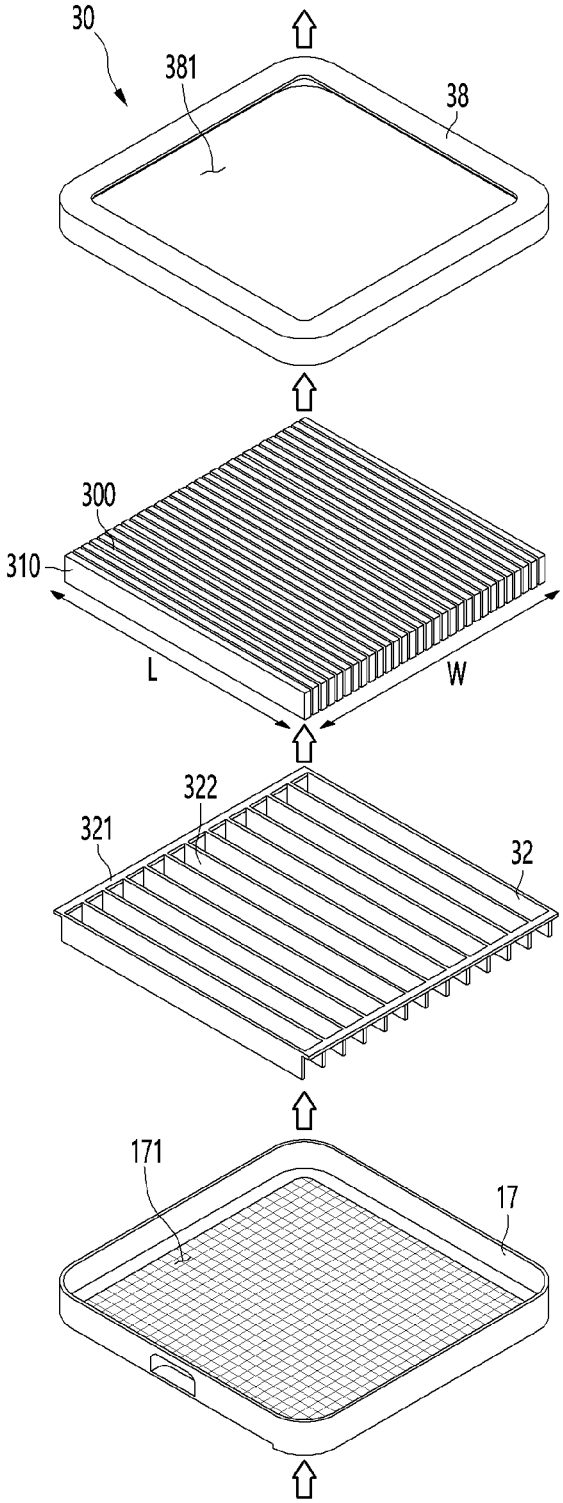
FIG. 12 is an exploded perspective view of an electric dust collecting device according to a third embodiment of the present invention.

FIG. 12 is an exploded perspective view of an electric dust collecting device according to a third embodiment of the present invention.

Referring to FIGS. 1 and 12, an electric dust collecting filter 30 according to the third embodiment of the present invention includes a case 31 defining a main body, a charging part 32 that charges foreign matters in air, and a dust collecting part 300 that collects the foreign matters charged in the charging part 32.

A space may be defined in the case 31. The charging part 32 and the dust collecting part 300 may be disposed inside the case 31. The charging part 32 and the dust collecting part 300 may be disposed to be spaced apart from each other in the case 31.

The case 31 may include a charging case 37 accommodating the charging part 32 therein and a dust collecting case 38 accommodating the dust collecting part 300 therein. The charging part 32 may be coupled to the inside of the charging case 37. The dust collecting part 300 may be coupled to the inside of the dust collecting case 38. The charging case 37 and the dust collecting case 38 may be coupled to each other.

The charging case 37 may be provided with an inflow part 371 through which external air flows. A discharge part 381 through which the air introduced into the inflow part 371 is discharged may be provided in the dust collecting case 38. That is, the air introduced into the inflow part 371 may be discharged to the discharge portion 381 after sequentially passing through the charging part 32 and the dust collecting part 300. Also, a prefilter, a mesh filter, and the like for filtering foreign matters having relatively large particles from the flowing air may be further provided in the inflow part 371 and the discharge part 381.

The charging part 32 is discharged by a high voltage to charge the foreign matters in the air. The charging part 32 may include a plurality of wire electrodes 321, to which the high voltage is applied, and a plurality of counter electrode plates 322 spaced apart from each of the plurality of wire electrodes. When the high voltage is applied to the wire electrode 321, the charging part 32 generates corona discharge between the wire electrode 321 and the counter electrode plate 322 to ionize molecules in the air. The ions generated in the charging part 32 may charge the foreign matters in the air. For example, high-voltage DC power may be applied to the charging part 32.

The charging part 32 may be provided to correspond to the inflow part 371 and may be disposed inside the charging case 37. The charging part 32 may be fixed by being coupled to the inside of the charging case 37. The charging part 32 may be disposed upstream of the dust collecting part 300 with respect to an air flow inside the case 31. The charging part 37 and the dust collecting part 300 may be disposed to be spaced apart from each other. A ground part (not shown) that is grounded to the power source 19 (see FIG. 6) to which the high voltage is applied may be connected to the charging part 32.

The dust collecting part 300 may collect the charged foreign matters by generating the electric fields. When the high voltage is applied to the dust collecting part 300, electrostatic force may be generated to collect the foreign matters charged in the charging part 32 in the dust collecting part 300 by the electrostatic force. The dust collecting part 300 may be provided to correspond to the discharge part 381 and may be disposed inside the dust collecting case 38. The dust collecting part 300 may be fixed to the inside of the dust collecting case 38. The dust collecting part 300 may be disposed downstream of the charging part 32 with respect to the air flow inside the case 31. The power source 19 for applying the high voltage and the ground part (not shown) for grounding may be connected to the dust collecting part 300.

That is, according to the present invention, the charging part 32 may be disposed upstream of the dust collecting part 300 with respect to the air flow inside the case 31 to increase in amount of foreign matters collected in the dust collecting part 300 and remove more foreign matters from the air.

The invention claimed is:

1. An electric dust collecting filter comprising:
- a plurality of film electrodes spaced apart from one another and configured to generate electric fields to collect foreign matters in air,
- wherein each of the plurality of film electrodes comprises:
  - an insulating part that defines a first surface of a film electrode among the plurality of film electrodes and a second surface of the film electrode,
  - a first electrode part disposed at a first inside surface of the insulating part, the first electrode part comprising a plurality of first wire electrodes spaced apart from one another, and
  - a second electrode part disposed at a second inside surface of the insulating part facing the first inside surface, the second electrode part comprising a plurality of second wire electrodes that are spaced apart from one another and alternately disposed with the plurality of first wire electrodes, each of the plurality of second wire electrodes being disposed between two adjacent ones of the plurality of first wire electrodes.

2. The electric dust collecting filter according to claim 1, wherein the first electrode part further comprises a first electrode part body connected to the plurality of first wire electrodes and a first power apply part configured to receive power from a power source,
- wherein the second electrode part further comprises a second electrode part body connected to the plurality of second wire electrodes and a second power apply part configured to receive power from the power source, and
- wherein the plurality of first wire electrodes extend from the first electrode part body, and the plurality of second wire electrodes extend from the second electrode part body.

3. The electric dust collecting filter according to claim 2, wherein the plurality of first wire electrodes extend from the first electrode part body toward the second electrode part body, and
- wherein the plurality of second wire electrodes extend from the second electrode part body toward the second electrode part body.

4. The electric dust collecting filter according to claim 1, wherein each of the plurality of film electrodes further comprises one or more electrode parts spaced apart from the first electrode part and the second electrode part.

5. The electric dust collecting filter according to claim 4, wherein the one or more electrode parts comprise a plurality of third electrode parts, and
- wherein each of the third electrode parts comprises:
  - a third electrode part body configured to receive power from a power source; and
  - a third wire that extends from the third electrode part body and is disposed between a first wire among the plurality of first wire electrodes and a second wire among the plurality of second wire electrodes, the first wire and the second wire being positioned adjacent to each other.

6. The electric dust collecting filter according to claim 5, wherein the third wire extends in a direction parallel to the first wire and the second wire.

7. The electric dust collecting filter according to claim 6, wherein the first wire, the second wire, and the third wire are alternately disposed.

8. The electric dust collecting filter according to claim 6, wherein the plurality of film electrodes are configured to collect the foreign matters in the air based on different outputs of direct current (DC) power being respectively applied to a first film electrode and a second film electrode that are disposed adjacent to each other among the plurality of film electrodes, and wherein the plurality of film electrodes are configured to separate the foreign matters from the plurality of film electrodes based on different outputs of alternating current (AC) power being respectively applied to the first electrode part, the second electrode part, and the third electrode part of each of the first film electrode and the second film electrode.

9. The electric dust collecting filter according to claim 8, wherein the plurality of film electrodes are configured to, based on the foreign matters being separated from the plurality of film electrodes, change moving directions of the foreign matters by the electric fields generated in the first film electrode and the second film electrode.

10. The electric dust collecting filter according to claim 1, wherein the plurality of film electrodes are configured to, based on different outputs of alternating current (AC) power being respectively applied to the first electrode part and the second electrode part, separate the foreign matters from the plurality of film electrodes.

11. The electric dust collecting filter according to claim 1, wherein the plurality of film electrodes are configured to, based on different outputs of direct current (DC) power being respectively applied to a first film electrode and a second film electrode that are adjacent to each other among the plurality of film electrodes, collect the foreign matters in the air by an electric field generated between the first film electrode and the second film electrode.

12. The electric dust collecting filter according to claim 11, wherein the first electrode part and the second electrode part of the first film electrode are configured to receive a same polarity of the DC power, and wherein the first electrode part and the second electrode part of the second film electrode are configured to receive a same polarity of the DC power.

13. The electric dust collecting filter according to claim 1, wherein the plurality of first wire electrodes and the plurality of second wire electrodes extend in an extension direction, and allow the air to flow along the extension direction.

* * * * *